US011344457B2

(12) United States Patent
Calkin

(10) Patent No.: US 11,344,457 B2
(45) Date of Patent: May 31, 2022

(54) RESCUE STRETCHER

(71) Applicant: Skedco, Inc., Tualatin, OR (US)

(72) Inventor: Carston R. Calkin, Tualatin, OR (US)

(73) Assignee: SKEDCO, INC., Tualatin, OR (US)

( * ) Notice: Subject to any disclaimer, the term of this patent is extended or adjusted under 35 U.S.C. 154(b) by 0 days.

(21) Appl. No.: 16/931,095

(22) Filed: Jul. 16, 2020

(65) Prior Publication Data

US 2021/0015689 A1 Jan. 21, 2021

Related U.S. Application Data

(60) Provisional application No. 62/875,377, filed on Jul. 17, 2019.

(51) Int. Cl.

| | |
|---|---|
| ***A61G 1/04*** | (2006.01) |
| ***A61G 1/044*** | (2006.01) |
| ***A61G 1/013*** | (2006.01) |
| ***A61G 1/048*** | (2006.01) |

(52) U.S. Cl.

CPC ..... *A61G 1/044* (2013.01); *A61G 1/013* (2013.01); *A61G 1/042* (2016.11); *A61G 1/048* (2013.01)

(58) Field of Classification Search

CPC ... A61G 1/00; A61G 1/01; A61G 1/04; A61G 1/044; A61G 1/013; A61G 1/048

See application file for complete search history.

(56) References Cited

U.S. PATENT DOCUMENTS

| | | | |
|---|---|---|---|
| 1,270,107 | A | 6/1918 | Boardman |
| 2,361,789 | A | 10/1944 | Nicholas |
| 2,366,082 | A | 12/1944 | Baker |
| 2,788,530 | A | 4/1957 | Ferguson |
| 2,899,692 | A | 8/1959 | Finken |
| 2,935,751 | A | 5/1960 | Emmick et al. |
| 3,046,982 | A | 7/1962 | Davis |
| 3,158,875 | A | 12/1964 | Fletcher |
| 3,287,895 | A | 11/1966 | Hire |
| 3,707,734 | A | 1/1973 | Matthews |
| 4,127,120 | A | 11/1978 | Applegate |
| 4,151,842 | A | 5/1979 | Miller |
| 4,283,068 | A | 8/1981 | Keyser |
| 4,347,635 | A | 9/1982 | Eisenhauer |
| 4,601,075 | A | 7/1986 | Smith |
| 5,014,374 | A | 5/1991 | Williams |
| 5,027,833 | A | 7/1991 | Calkin |

(Continued)

OTHER PUBLICATIONS

International Searching Authority, International Search Report and Written Opinion for Application No. PCT/US2020/042366, dated Oct. 7, 2020, 10 pages.

(Continued)

*Primary Examiner* — Fredrick C Conley

(74) *Attorney, Agent, or Firm* — Stoel Rives LLP

(57) ABSTRACT

A stretcher including a flexible base panel sized to support a person lying thereon during a rescue or extrication operation. The base panel includes a header end and an opposite footer end, and further includes a plurality of securement straps coupled to the base panel to help restrain the injured person and prevent further injury that may be caused such as by having the person roll off the sides of the stretcher. The disclosure further relates to a method of deploying the stretcher to access and remove an injured person from a confined area to provide treatment.

14 Claims, 7 Drawing Sheets

(56) References Cited

U.S. PATENT DOCUMENTS

| | | | | |
|---|---|---|---|---|
| 5,048,134 | A | 9/1991 | Dennill et al. | |
| 5,121,514 | A | 6/1992 | Rosane | |
| 5,211,186 | A | 5/1993 | Shoemaker et al. | |
| 5,285,797 | A | 2/1994 | Zeller | |
| 5,729,850 | A | 3/1998 | Eskeli | |
| D421,413 | S | 3/2000 | Calkin | |
| 6,227,201 | B1 | 5/2001 | Ferko, III | |
| 6,871,368 | B2 | 3/2005 | Calkin | |
| 6,966,087 | B2 | 11/2005 | Robinette | |
| 7,422,220 | B2 | 9/2008 | Walkingshaw et al. | |
| 7,810,820 | B2 | 10/2010 | Wolf et al. | |
| 8,677,530 | B2 | 3/2014 | Calkin | |
| D712,796 | S | 9/2014 | Calkin | |
| 9,827,152 | B1 | 11/2017 | Calkin | |
| 2004/0088794 | A1* | 5/2004 | Calkin | A61G 1/01 5/628 |
| 2007/0136950 | A1 | 6/2007 | Zuercher | |
| 2007/0192926 | A1* | 8/2007 | Fee | A62B 35/0037 2/81 |
| 2010/0005593 | A1 | 1/2010 | Bowling et al. | |
| 2010/0233922 | A1 | 9/2010 | Cynamon | |
| 2011/0185504 | A1 | 8/2011 | Kenalty et al. | |
| 2011/0296609 | A1 | 12/2011 | Giap | |
| 2012/0102650 | A1 | 5/2012 | Mcglynn | |
| 2012/0151679 | A1 | 6/2012 | Kenalty et al. | |
| 2015/0143634 | A1* | 5/2015 | Beaulieu | A61G 1/01 5/626 |
| 2015/0313778 | A1 | 11/2015 | Chia et al. | |
| 2016/0075539 | A1 | 3/2016 | Calkin | |
| 2016/0176683 | A1 | 6/2016 | Huehn | |

OTHER PUBLICATIONS

ARC Products, Med-Sled Vertical Lift Rescue, 2009, 2 pgs.

International Search Report and Written Opinion for International Application No. PCT/US2019/019284, dated Jun. 24, 2019, 11 pages.

Veasey, et al., "Confined Space Entry and Emergency Response", 2002, pp. 429-433, The McGraw-Hill Companies, Inc., U.S.

* cited by examiner

RESCUE STRETCHER

RELATED APPLICATION DATA

This application is a nonprovisional of and claims the benefit under 35 U.S.C. § 119(e) of U.S. Provisional Patent Application No. 62/875,377 filed Jul. 17, 2019, the disclosure of which is incorporated by reference herein in its entirety.

TECHNICAL FIELD

The field of the disclosure relates generally to rescue stretchers with straps for securing and transporting an injured person to the rescue stretcher during emergency situations. In particular, the disclosure relates to such rescue stretchers designed to be quickly deployable and used for rescue operations in tight spaces and confined areas.

BACKGROUND

Transporting an incapacitated or injured person to a hospital or other treatment facility is often an essential part of providing proper medical care. An ambulance, helicopter, or other similar vehicle is well-known for such transport. However, in some instances, such as when the injured person is in a forested area, on an embankment, on a battlefield, or trapped in small spaces, such as in vehicles or destroyed buildings, transport vehicles may not be a feasible option and/or personnel may have difficulty accessing the location of the injured person. In such cases, the injured person may be transported from the injury site to another location (e.g., a medical tent) either for treatment, or for loading onto an ambulance (or other rescue vehicle) and thereafter taken to the hospital or other treatment facility. In these situations, lightweight and easily deployable stretchers, litters, and other similar devices are generally known for facilitating such casualty movement. To help prevent further injury, these devices generally include restraints or straps to immobilize the injured person during transport.

The present inventor has recognized several disadvantages with such conventional lightweight stretchers. For example, many such stretchers are stored in rolled-up configurations to minimize storage space. However, stretchers in rolled-up configurations are difficult to stack and must be properly secured or they may become cumbersome, especially when they are stored in smaller vehicles or in vehicles where storage space is not readily available (e.g., ambulances, military vehicles, fire trucks). In addition, many such stretchers cannot be easily deployed to rescue injured people located in smaller spaces, such as a driver in a military tank or other vehicle without opening side doors where access to the driver is extremely limited.

In addition, many lightweight stretchers lack sufficient support for the injured person to minimize the potential of causing further injury during transport. For example, during some rescue operations, the injured person may be dragged across rough terrain (e.g., rocks, rubble, or other debris) on the lightweight stretcher. Without appropriate support, the debris may cause discomfort and possibly further injury as the injured person is dragged through the debris. Moreover, many lightweight stretchers are not sufficiently sturdy or otherwise equipped to support air lift evacuations while firmly restraining the injured person in the rescue stretcher and protecting the person to avoid causing further injury.

Accordingly, the present inventor has recognized a need for an improved rescue stretcher that offers a streamlined design for quick deployment, efficient patient packaging, and rapid horizontal and/or vertical hoist capabilities for expeditious evacuations. The present inventor has also recognized a need for such an improved rescue stretcher with various attachment points to facilitate air lift evacuations, and to provide protective support for the injured person during transport. The present inventor has also recognized a need for such an improved rescue stretcher designed to be compact for improved storage and ease of deployment. In addition, the present inventor has also recognize a need for such a rescue stretcher designed to be easily and quickly deployable to reach an injured person located in a tight and enclosed area. Additional aspects and advantages will be apparent from the following detailed description of example embodiments, which proceeds with reference to the accompanying drawings.

DETAILED DESCRIPTION OF EXAMPLE EMBODIMENTS

Figure 1:
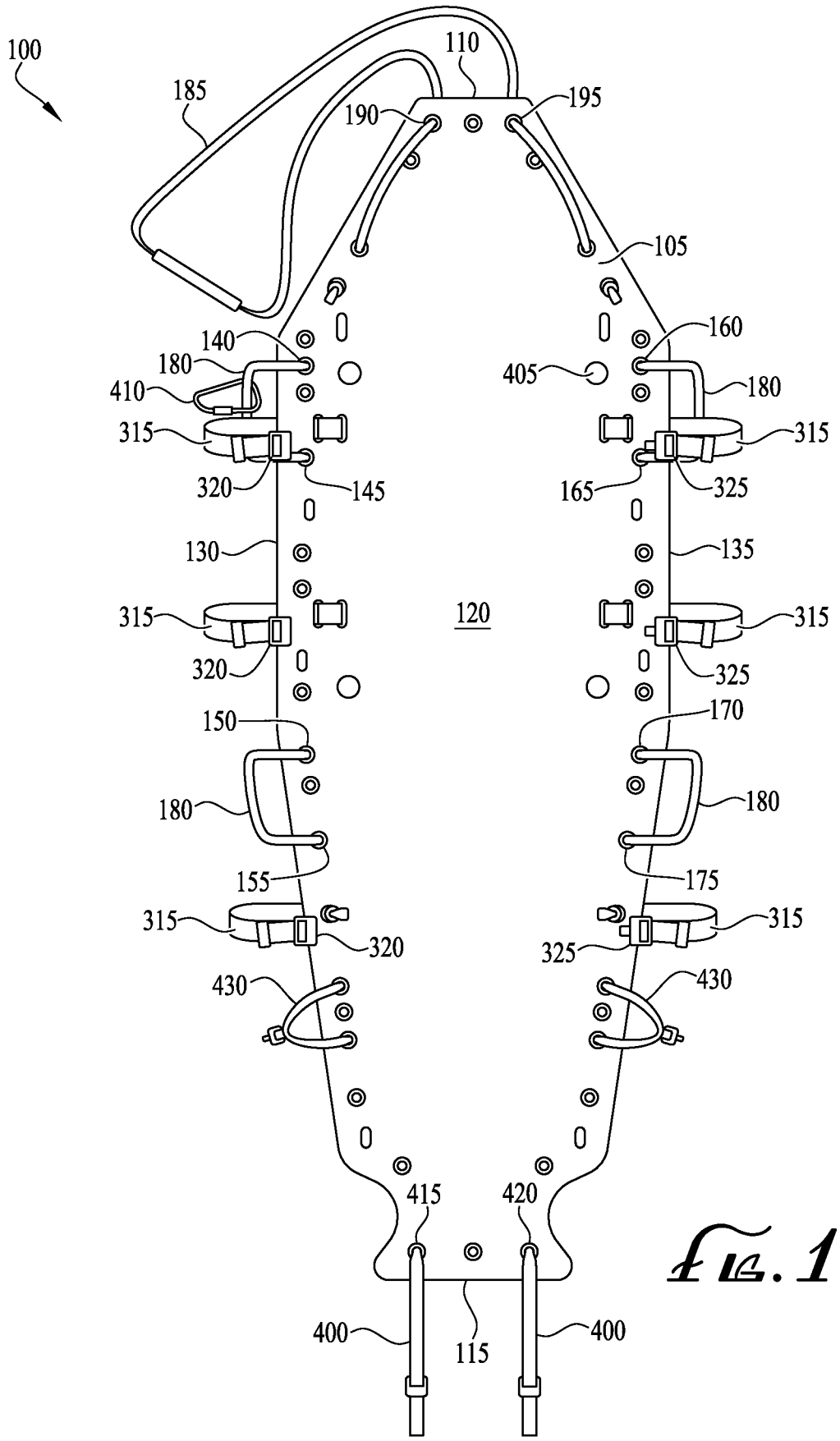
FIG. 1 illustrates a rescue stretcher in a flat configuration in accordance with one embodiment.
Figure 2:
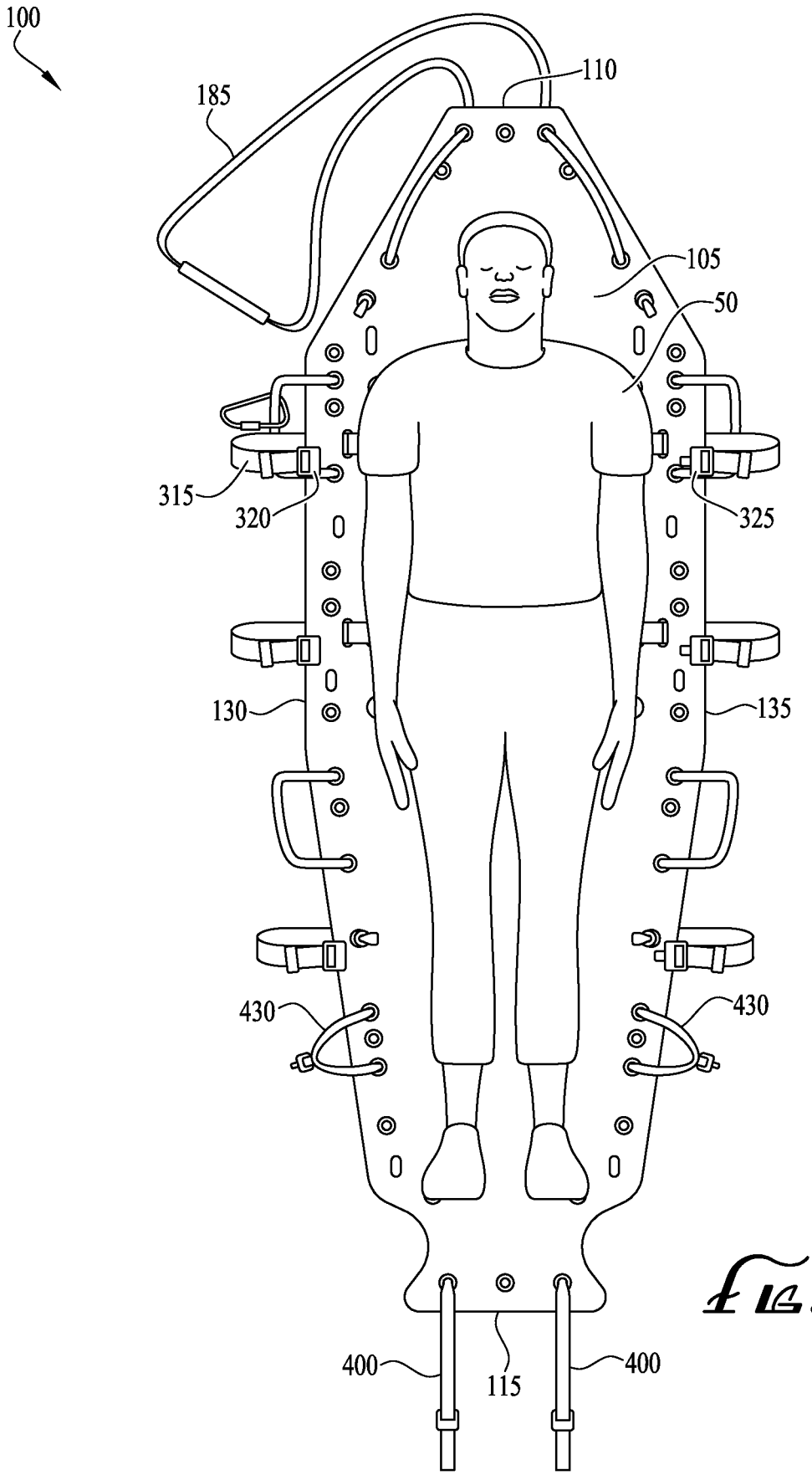
FIG. 2 illustrates an injured person resting on the rescue stretcher of FIG. 1.

With reference to the drawings, this section describes embodiments of a rescue stretcher and its detailed construction and operation. Throughout the specification, reference to "one embodiment," "an embodiment," or "some embodiments" means that a described feature, structure, or characteristic may be included in at least one embodiment. Thus, appearances of the phrases "in one embodiment," "in an embodiment," or "in some embodiments" in various places throughout this specification are not necessarily all referring to the same embodiment. Furthermore, the described features, structures, and characteristics may be combined in any suitable manner in one or more embodiments. In view of the disclosure herein, those skilled in the art will recognize that the various embodiments can be practiced without one or more of the specific details or with other methods, components, materials, or the like. In some instances, well-known structures, materials, or operations are not shown or not described in detail to avoid obscuring aspects of the embodiments.

FIGS. 1-8 collectively illustrate various details and embodiments of a rescue stretcher 100, 700 that may be used to support and safely extract an injured person 50 from a hazardous environment. With general reference to FIG. 1, the rescue stretcher 100 includes an elongated, flexible base panel 105 panel having a plurality of eyelets 140, 145, 150, 155, 160, 165, 170, 175 spaced along left and right peripheral edges 130, 135, respectively of the base panel 105. A plurality of loop handles 180 are weaved through the eyelets 140, 145, 150, 155, 160, 165, 170, 175 to couple the loop handles 180 to the base panel 105. Base panel 105 further includes a plurality of eyelets 190, 195 spaced along the header end 110 to receive a drag handle or strap 185, and eyelets 415, 420 spaced along footer end 115 of the base panel 105 through which is weaved a pair of foot end straps 400. As further described in detail below, the loop handles 180 may be used to aid evacuation personnel in carrying the injured person 50 from the hazardous environment to another location for treatment.

The rescue stretcher 100 further includes various slings and/or straps 315, 350, 355 (see FIG. 5) used to secure the person 50 to the base panel 105 for transport, such as for dragging extractions and air-lift rescues. As further described in detail below, the slings and straps may be coupled to the rescue stretcher 100 to facilitate efficient deployment for both horizontal and vertical hoist extractions. In one example configuration, the securement straps 315 extend transversely across the base panel 105. When securement straps 315 are tightened, base panel 105 rolls inwardly to at least partially cradle person 50 and help prevent person 50 from rolling off the base panel 105 (e.g., such as via left and right peripheral edges 130, 135). The securement straps 315 and foot end straps 400, when secured and tightened, support the person 50 and collectively limit movement of the person 50 toward the header end 110 and the footer end 115 of rescue stretcher 100. As illustrated, the foot end straps 400 extend inwardly from the peripheral edges 130, 135 respectively, toward the footer end 115 and urge the footer end 115 to roll inwardly to create a foot rest and arrest movement of the person downwardly toward the footer end 115.

Figure 7:
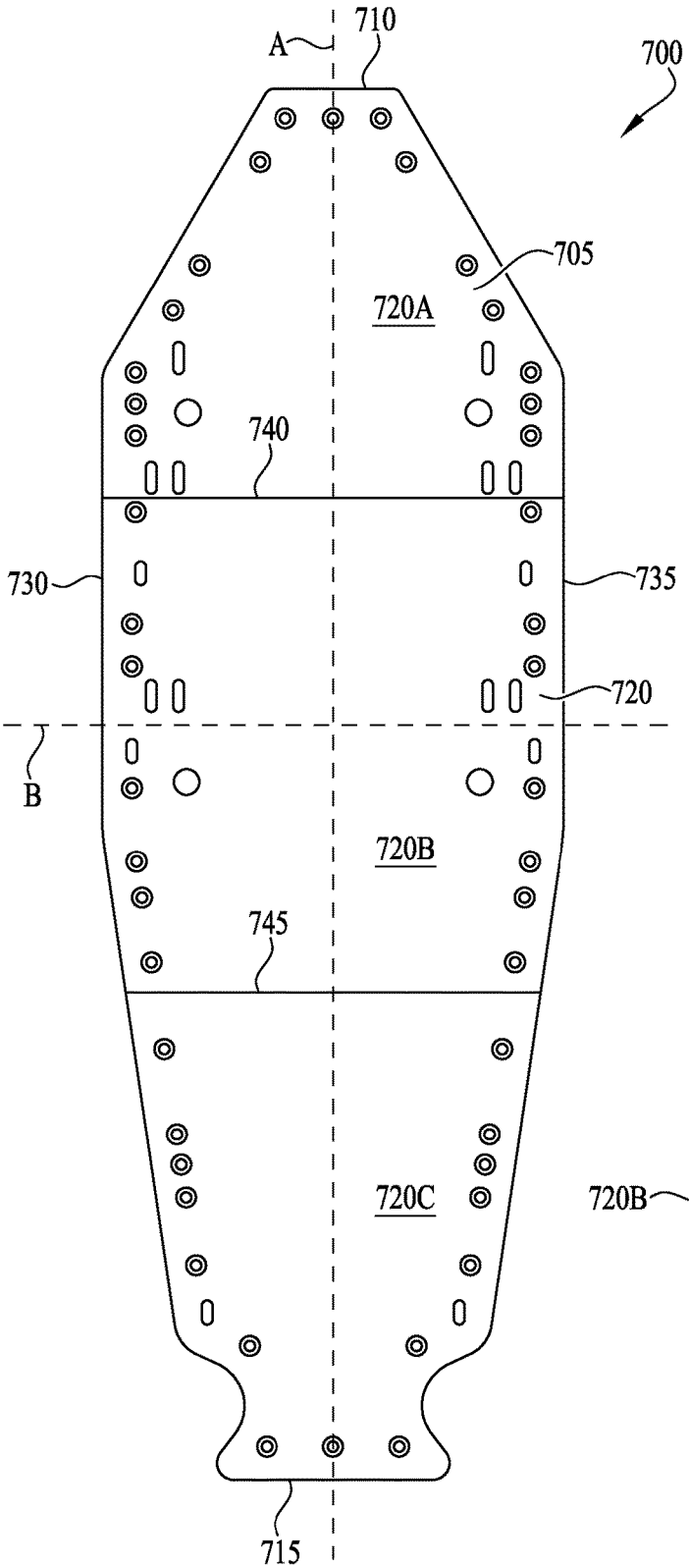
FIG. 7 is a top view of a rescue stretcher in accordance with another embodiment, where the rescue stretcher is foldable for compact storage.
Figure 8:
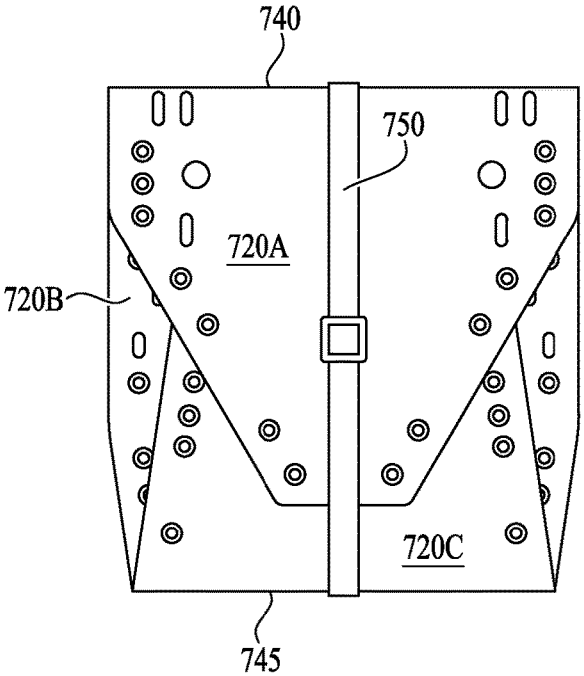
FIG. 8 is a top view of the rescue stretcher of FIG. 7 illustrated in a folded configuration in accordance with one embodiment.

As illustrated in FIGS. 7-8, one embodiment of the rescue stretcher 700 further includes a plurality of crease lines 740, 745 extending across the base panel 105 from the left peripheral edge 730 to the right peripheral edge 735. The crease lines 740, 745 help facilitate folding of the base panel 105 at particular locations to create a compact footprint for the rescue stretcher 700 as illustrated in FIG. 8. The compact footprint may help minimize storage space of the rescue stretcher 700, such as by providing a stackable configuration for a plurality of rescue stretchers 700. A retaining strap 750 may be used to maintain the rescue stretcher 700 in a folded configuration for easy storage and quick deployment as needed. The following describes further detailed aspects of this and other embodiments of rescue stretcher 100, 700 with reference to the figures.

In the following description of the figures and any example embodiments, reference may be made to using the rescue stretcher disclosed herein to support and transport injured person. It should be understood that any such references merely refer to one prospective use for such a rescue stretcher and should not be considered as limiting. Other uses for such rescue stretcher with the characteristics and features described herein are possible, including uses to transport captured animals/game, or transporting equipment, firewood, ammunition, or other heavy loads (including both military and civilian uses). Still other uses not specifically described herein may be possible. In addition, the following disclosure may include references to an injured person's body parts and/or particular regions of the body. It should be understood that any such discussion is meant to facilitate description and establish a frame of reference relating to a typical injured person with all limbs and body parts intact. Accordingly, any such references are for convenience only and should not be considered as limiting.

FIG. 1 illustrates a top view of a rescue stretcher 100 in a flat configuration in accordance with one embodiment. With general reference to FIG. 1, the rescue stretcher 100 includes an elongated base panel 105 formed of a lightweight and flexible material with strength and durability characteristics suitable for supporting the weight of an injured person 50 during transport. In one embodiment, base panel 105 comprises a single sheet of lightweight plastic material, such as medium-density polyethylene or a synthetic thermoplastic resin, selected for durability, strength, flexibility and resistance to damage (such as from cutting, scarring, denting, breaking, and deforming) to provide a suitable rescue stretcher 100 for carrying injured people. Base panel 105 includes a header end 110 and a footer end 115 opposite header end 110. Base panel 105 further includes a front surface 120 and an opposite back surface (not shown), and opposite left and right peripheral edges 130, 135. To establish a frame of reference, front surface 120 refers to a surface of base panel 105 that receives injured person 50 during use of rescue stretcher 100. The back surface refers to the opposite surface of the base panel 105 that may contact the ground, such as during a dragging operation.

Overall, base panel 105 may have suitable dimensions for receiving and comfortably supporting injured person 50. For instance, in one example embodiment, base panel 105 may have a length (as measured from header end 110 to footer end 115) ranging from between 80-100 inches and a width (as measured from left edge 130 to right edge 135) ranging from between 24 to 30 inches. Base panel 105 may range in thickness from between 1/16 inches to about 1/4 inches. It should be understood that the dimensions described illustrate one example embodiment and that any suitable dimensions may be used. For instance, the length and width dimensions may be smaller for rescue stretchers targeted primarily for use with children or may be wider and/or longer to accommodate various sizes for adult use.

Figure 3:
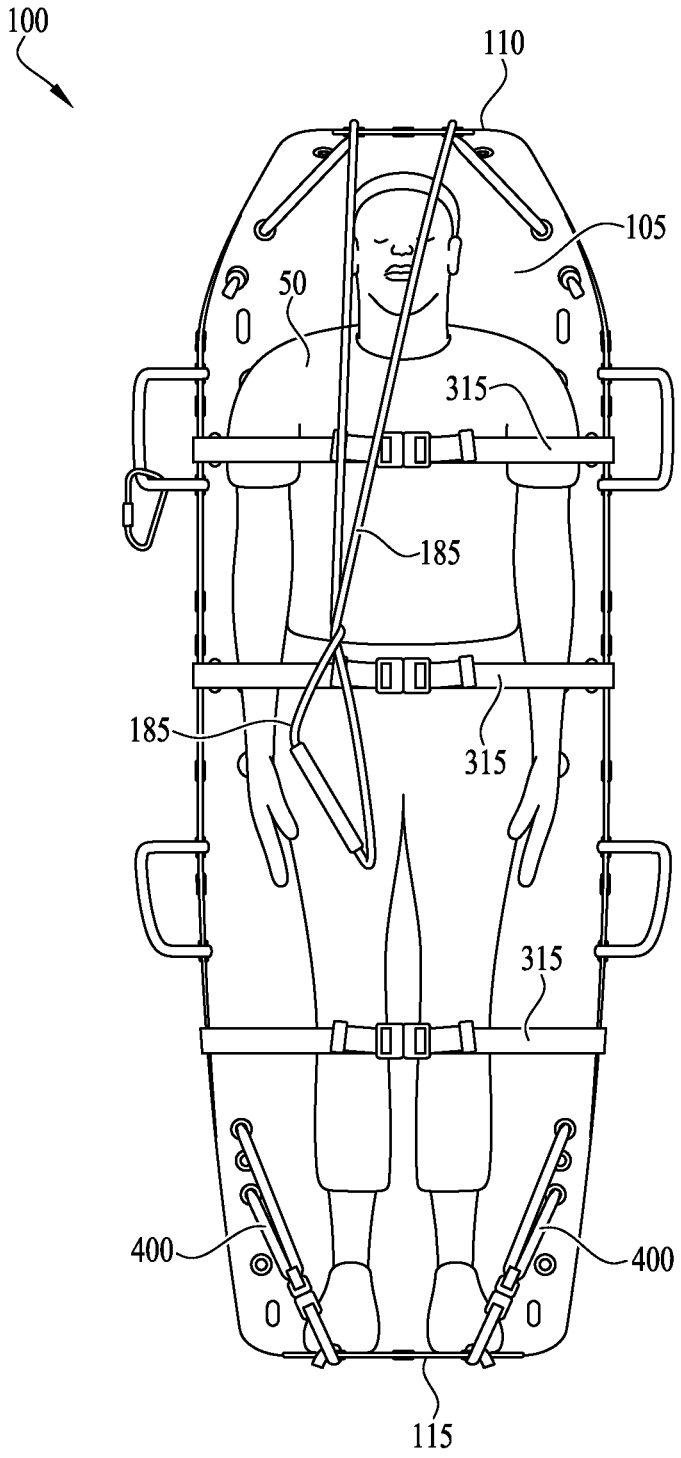
FIG. 3 illustrates the injured person secured to the rescue stretcher of FIG. 1 in accordance with one embodiment.

As illustrated in FIG. 1, in some embodiments, base panel 105 may not have a uniform width throughout but may include one or more tapered sections. For example, with reference to FIG. 1, left and right peripheral edges 130, 135 of base panel 105 may taper inwardly toward header end 110 from an upper portion of the base panel 105 (e.g., near the shoulder area of the person 50), and may taper inwardly toward footer end 115 from a lower portion of the base panel 105 (e.g., from the upper thigh region of the person 50) in some embodiments. In some embodiments, the left and right peripheral edges 130, 135 may uniformly and gradually taper toward header end 110 to define a generally trapezoidal upper region for supporting the head of the injured person 50. In such embodiments, base panel 105 is narrower at header end 110 as compared to a generally central body-supporting region of the base panel 105. In such a configuration, rescue stretcher 100 receives and supports the head of injured person 50 without obstructing the sides of the head of injured person 50 when rescue stretcher 100 is in an operative configuration (for example, as illustrated in FIG. 3). Similarly, left and right peripheral edges 130, 135 may gradually taper or curve inwardly toward the footer end 115 to accommodate the lower leg region of the injured person 105.

With general reference to FIG. 1, base panel 105 includes a plurality of eyelets or apertures 140, 145, 150, 155, 160, 165, 170, 175 that may be drilled, cut, punched, machined, or otherwise formed using any suitable techniques. In some embodiments, some or all of eyelets 140, 145, 150, 155, 160, 165, 170, 175 may be reinforced using metal grommets (which may also be referred to as eyelets herein) to reduce the tearing risk of the base panel 105. The eyelets 140, 145, 150, 155, 160, 165, 170, 175 may each be spaced inwardly between approximately two to four inches from the corresponding peripheral edges 130, 135 of the base panel 105. In one embodiment, eyelets 140, 145 on the peripheral edge 130 of the base panel 105 and eyelets 160, 165 on the peripheral edge 135 of the base panel 105 are arranged in a mirrored configuration such that eyelet 140 is horizontally aligned with eyelet 150, and eyelet 145 is horizontally aligned with eyelet 165. Eyelets 150, 155, 170, 175 may be arranged in a corresponding configuration.

The rescue stretcher 100 includes a plurality of loop handles 180, each loop handle 180 threaded through a corresponding pair of eyelets of base panel 105. In such configuration, the loop handles 180 form handle pairs on either side of the base panel 105, with each loop handle 180 sufficiently spaced apart from an adjacent loop handle 180, to provide adequate spacing to allow for people to carry rescue stretcher 100 during an extraction operation. Loop handles 180 are generally sized to accommodate an adult human hand and may be formed from reinforced webbing material to provide sufficient strength for carrying the load on the base panel 105. In other embodiments, loop handles 180 may be formed from other suitable materials. Some other embodiments may include more or fewer loop handles 180 arranged in a different configuration as described herein.

In some embodiments, the rescue stretcher 100 may include a drag strap or drag handle 185 threaded through a pair of eyelets 190, 195 located along header end 110 of the base panel 105. The drag strap 185 extends upwardly beyond the header end 110 of rescue stretcher 100, and may include a looped handle to provide a grasping point for rescue personnel. In some embodiments, the drag strap 185 may be made of reinforced webbing or other suitable material with sufficient tensile strength for carrying out a dragging extraction operation of an adult person 50. In other embodiments, rescue stretcher 100 may include multiple drag straps for facilitating dragging by more than one rescuer or allowing a single rescuer to pull the person 50 with both hands. For example, instead of a looped drag strap 185, rescue stretcher 100 may include two individual straps (not shown) without a looped handle, where one strap is laterally spaced apart from the other strap and each is threaded through an individual eyelet on header end 110. Other arrangements not specifically described herein may be possible.

With reference to FIG. 1, the rescue stretcher 100 further includes a plurality of securement straps 315 stretching transversely across base panel 105 and over person 50 for securing person 50 in rescue stretcher 100 when in use (see FIG. 3). Each securement strap 315 includes mating first and second buckle parts 320, 325 of a two-piece buckle system for securing person 50 on rescue stretcher 100. When the securement straps 315 are fastened via the mating buckles 320, 325 and cinched tightly over the injured person 50, the securement straps 315 restrain the injured person 50 against the support mat 200 and the base panel 105, and also maintain the inwardly curved or rolled profile of the rescue stretcher 100 to further protect the injured person 50.

Preferably, the securement straps 315 are each made of a continuous elongate strip of sturdy fabric, such as woven nylon webbing, although, other reinforced materials may also be suitable. In other embodiments, the straps 315 may not be continuous and may instead comprise multiple segments of material. In addition, various buckle types may be used for the described two-piece buckle, such as a three-way buckle, double bar buckle, swivel bar buckle, or others. Preferably, the buckle parts described above are each constructed from strong materials, such as metals, but may otherwise be constructed from other suitable materials.

Figure 4:
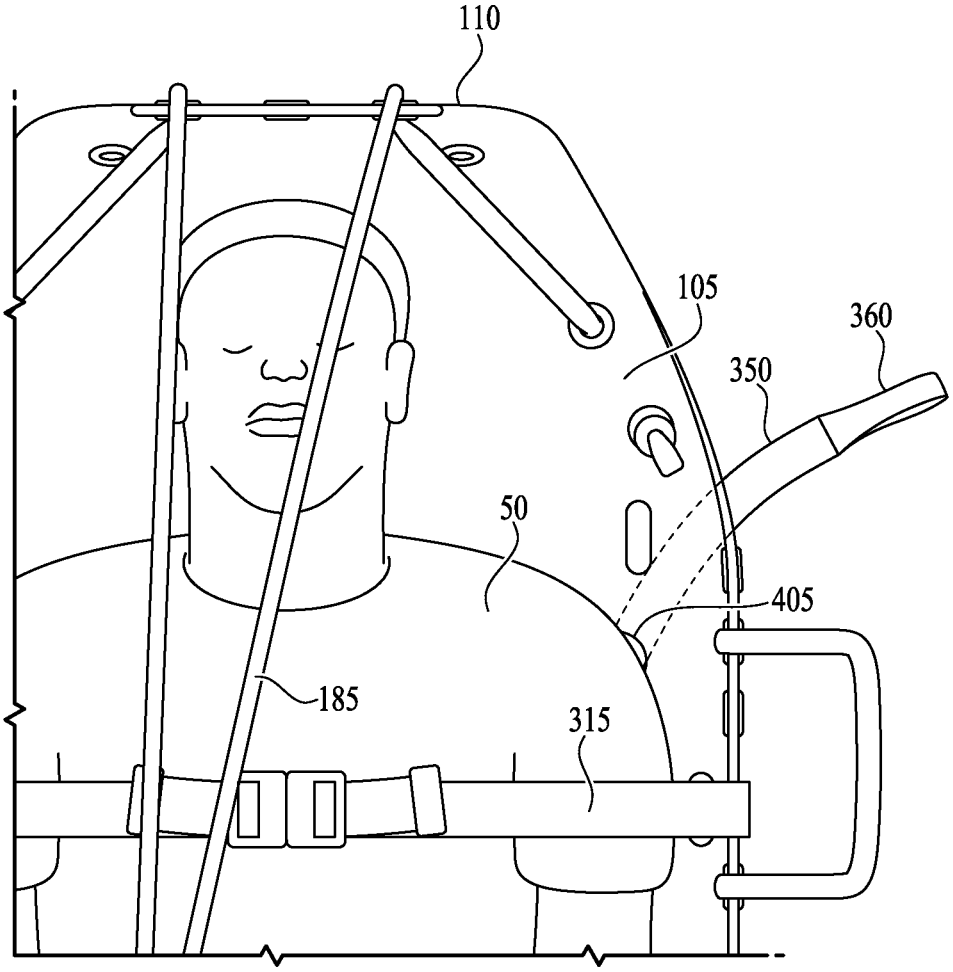
FIGS. 4-6 collectively illustrate a process for preparing the secured person for a horizontal lift or descent extraction.
Figure 5:
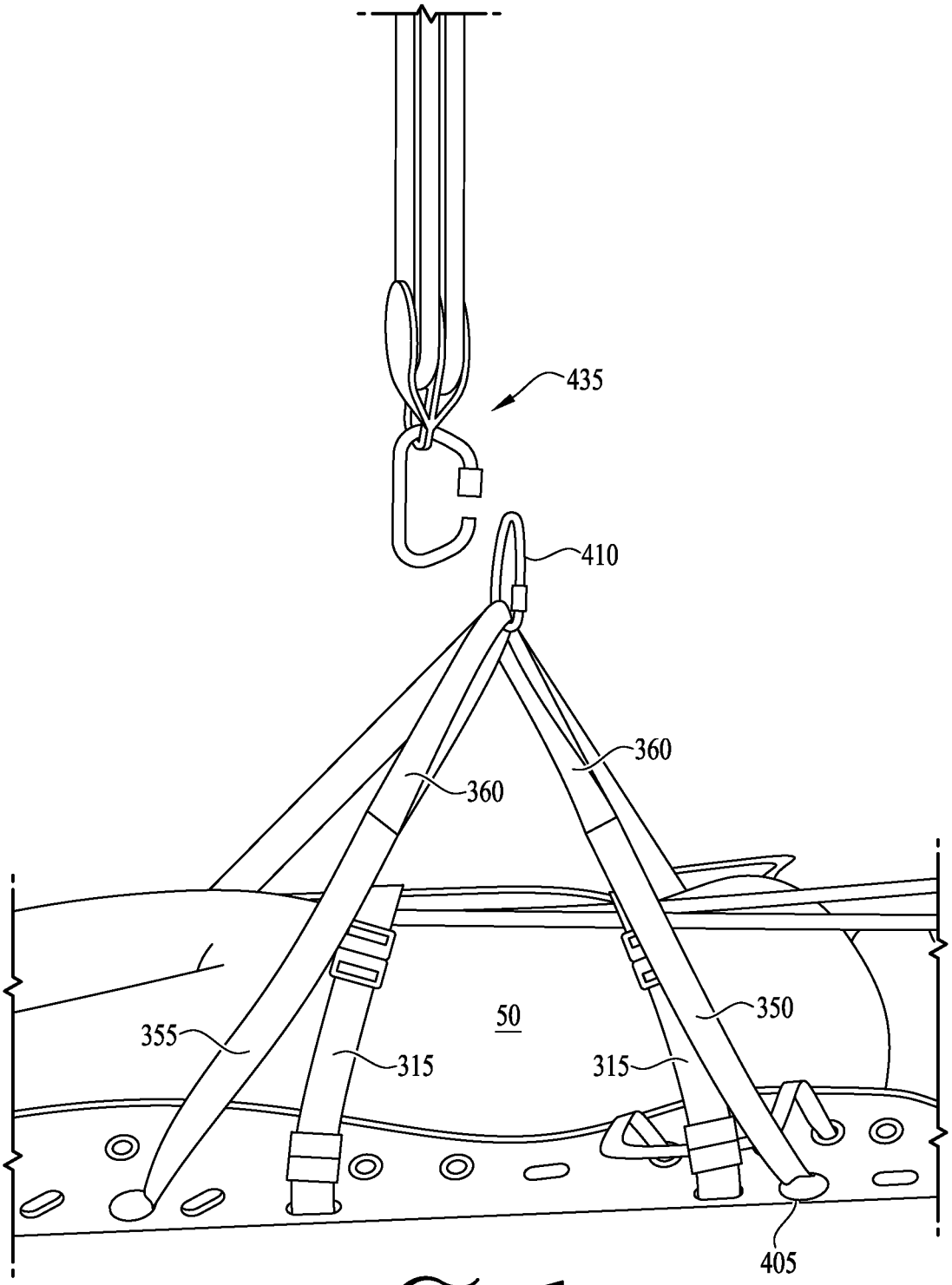

With collective reference to FIGS. 4-5, the rescue stretcher 100 further includes a pair of lift sling straps 350, 355, each sling strap 350, 355 stretching transversely across the base panel 105, with a large portion of the sling straps 350, 355 positioned underneath the injured person 50 when deployed. The sling straps 350, 355 each further include loop handles 360 formed on either end of the respective straps 350, 355 to aid in a horizontal lift or descent (such as an air lift) as further described in detail below with reference to FIG. 6. The sling straps 350, 355 are preferably each a single strap of reinforced webbing material but may be formed as segmented pieces of material in other embodiments. In some embodiments, the sling straps 350, 355 may be initially coupled to one of the securement straps 315, the loop handles 180, or any other components of the base panel 105 for storage purposes. When ready for use, the sling straps 350, 355 may be released from the securement straps 315, loop handles 180, or other component and deployed as further described in detail below with particular reference to FIG. 6. Additional details relating to deployment of the rescue stretcher 100 are provided below with general reference to FIGS. 2-6.

FIGS. 2-6 collectively illustrate a deployment process of the rescue stretcher 100 to secure the person for a vertical lift or descent extraction. With general reference to FIGS. 2-6, the following description relates to an example deployment operation of the rescue stretcher 100. Prior to operation, the rescue stretcher 100 is buckled via the foot end straps 400 in a rolled-up configuration. Alternatively, the rescue stretcher 100 may be buckled in a folded and stacked configuration as further described with reference to FIGS. 7-8 below. In either configuration, the rescue stretcher 100 is carried to a position where injured person 50 is located. At the site, the rescue stretcher 100 is unbuckled, unrolled and laid flat on the ground with the rear of the base panel 105 contacting the ground. In some embodiments, the header and/or footer ends 110, 115 may need to be bent backward by the rescue personnel to reverse roll the header and/or footer ends 110, 115 and allow the base panel 105 to lay flat. For the folded configuration, the rescue stretcher 100 may also need to be folded back to allow the base panel 105 to lay flat.

With the base panel 105 flat on the ground, the person 50 is positioned onto the base panel 105 in any suitable method depending on the extent of the injuries and the available number of able-bodied personnel. For example, the person 50 may be lifted onto the base panel 105 in cases where the injuries allow and there are capable rescue personnel available to bear the weight of the person 50. In other instances, the base panel 105 may be positioned as close as possible to the person 50, and the person 50 may be dragged onto the base panel 105. To help prevent lateral movement of the patient's head and minimize further injury, rescue personnel may grasp the underarms of the person 50 to drag the person 50 onto the base panel 105 until the person's head is centered on the base panel 105 adjacent the header end 115. Once the person 50 is properly positioned on the base panel 105, person 50 is restrained on rescue stretcher 100 using the securement straps 315. To restrain the person 50, the securement straps 315 are released from the sleeves 330 by pulling outwardly to make them ready for deployment. The straps 315 are stretched transversely across person 50, secured via the mating buckle parts 320, 325, and cinched as necessary to secure the person 50. When straps 315 are cinched, left and right peripheral edges 130, 135 of base panel 105 roll inwardly toward one another so that base panel 105 cradles and better supports person 50. To further support the rolled configuration in the lower third portion of the rescue stretcher 100, the rescue stretcher 100 includes a lower securement strap 315 that extends transversely across the base panel 105. Once the securement strap 315 is fastened, the left and right peripheral edges 130, 135 of the base panel 105 curl inwardly in a similar fashion as described above. Finally, after the lower securement strap 315 is fastened, the foot side straps 430 on the left and right peripheral edges 130, 135 may be fastened and cinched to pull the footer end 115 inwardly and create a footrest section. The foot end straps 400 may be cinched as needed to allow the person's feet to rest against the curled footer end 115.

Once the person 50 is secured on rescue stretcher 100, rescue personnel can carry person 50 using the plurality of loop handles 180 or pull person 50 using drag strap 185 as necessary. In some operations, person 50 may be extracted using a combination of dragging and/or carrying techniques. For example, person 50 may be carried over some obstacles that are harder to maneuver around and dragged through narrow areas or in situations where only one rescuer is available.

Figure 6:
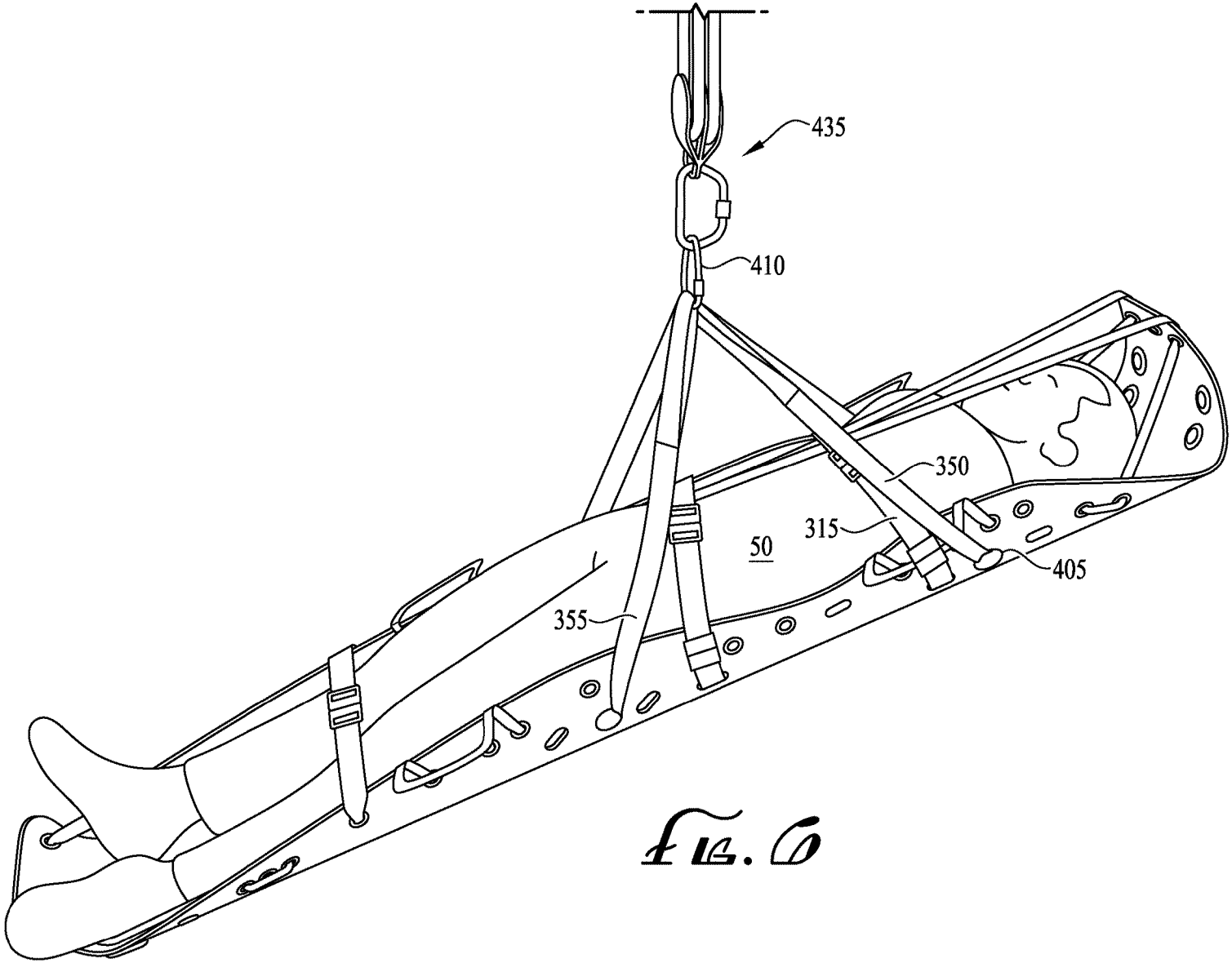

In still other rescue operations, a winch or haul device (not shown) may be necessary to lift the packaged person 50 from the rescue site. In such operations, the drag strap 185 may be pulled over the patient and knotted around or otherwise secured to the securement strap 315. This action curls the header end 110 upwardly over the patient's head. Thereafter, the sling straps 350, 355 are deployed. For example, with reference to FIG. 4, the loop handle 360 of the sling strap 350 is weaved through an opening 405 formed on the base panel 105 (see also FIG. 1) adjacent the shoulder area of the person 50. Preferably, the opening 405 is larger than the eyelet openings and is substantially circular or round to optimize weight distribution and avoid concentrating stresses that may damage the base panel 105 when the person 50 is lifted for evacuation. The loop handle 360 is inserted through the opening 405 and pulled underneath the base panel 105. The same process is repeated for the remaining loop handles 360 of the sling straps 350, 355. Once the four loop handles 360 have been weaved through the base panel 105, the loop handles 360 are equalized over the person 50 and secured together via a carabiner 410 or any other suitable connector device. The carabiner 410 in turn is connected into a winch hook or haul line 435 for extraction. As illustrated in FIG. 6, when the rescue stretcher 100 is hoisted, the rescue stretcher 100 automatically adjusts with a slight head up position to maximize patient comfort.

In yet another embodiment, the rescue stretcher 100 may be adapted for being quickly deployed for use in tight places. For example, in one embodiment, the rescue stretcher 100 may be used in the field to evacuate an injured driver in certain military vehicles. Briefly, some military vehicles are designed without standard driver or passenger side doors as is customary in standard civilian vehicles. In such military vehicles, the driver accesses the cockpit or driver's cabin (sometimes referred to as the "hellhole") by way of a small opening or narrow passageway that connects the rear portion of the vehicle to the cockpit or driver's cabin. Typically, the opening and/or cockpit are sufficiently small such that multiple people cannot freely occupy the passageway simultaneously in a side-by-side arrangement. Accordingly, if the driver becomes incapacitated due to an explosion, accident, medical emergency, or other catastrophic event, it can be very challenging to reach the driver to render aid. In such instances, the rescue stretcher 100 may be used to access the incapacitated driver and transport the driver out of the cockpit to an area for further treatment as needed. The description below provides an example deployment method of the rescue stretcher 100 for such scenarios.

In one embodiment, the rescue stretcher 100 is first unrolled (or unfolded as further described below with reference to FIGS. 7-8 in the case of a rescue stretcher 100 designed in a folded configuration) and laid in a flat configuration. Once the rescue stretcher 100 is flat, the rescue stretcher 100 is preferably laid on a flat surface, such as the bottom surface of the narrow passageway leading toward the driver. The rescue stretcher 100 is arranged with the header end 110 adjacent the driver (or other injured personnel) with all securement straps 315 of the rescue stretcher 100 being in an unbuckled state. Thereafter, the rescue stretcher 100 is slid against the bottom surface within the passageway toward the driver until the header end 110 of the rescue stretcher 100 is as close as possible to the driver.

With the rescue stretcher 100 in this position, rescue personnel may crawl or otherwise move into the passageway and over the rescue stretcher 100 to gain access to the driver. With rescue personnel in position, the personnel clips the carabiner 410 (or other suitable fastener) of the rescue stretcher 100 to any access point on the driver. The access point may be an existing loop present in the person's clothing or armor. If necessary, the rescue personnel may create an access point on the driver such as by cutting, tearing, or otherwise creating an opening on clothing. If the driver is accessible and close to the narrow passageway, the first securement strap 315 (i.e., the top-most securement strap adjacent the header end 110) may also be buckled around any accessible portion of the driver. For example, in some scenarios, rescue personnel may be able to secure the securement strap 315 around the upper torso, an arm, a leg or other body part. Preferably, the securement strap 315 is not secured around the head or neck of the driver or around any visible wound to avoid causing more serious injuries during the evacuation. Most often, however, due to the lack of spacing, it may be unfeasible to attach the first securement strap 315 to the driver, and only the carabiner 410 may be a viable attachment point.

If necessary or possible, any seatbelts or other restraints are cut or otherwise removed from the driver to allow for unimpeded removal. In addition, the driver seat may also be reclined or otherwise adjusted to provide optimal access to the driver. Once the carabiner 410 (and securement strap 315 if feasible) is secured to the driver, rescue personnel may pull the rescue stretcher 100 rearwardly away from the driver seat and through the passageway with sufficient force as needed to dislodge the driver from the driver seat. In some embodiments, the handles 180, the lower-most securement straps 315 adjacent the footer end 115 of the rescue stretcher 100, or other suitable strap of the rescue stretcher 100, may be used to provide a grip point or suitable leverage to firmly grasp the rescue stretcher 100 and pull as needed.

While the rescue stretcher 100 is pulled rearwardly through the passageway, the carabiner 410 and/or securement strap 315 couple the driver to the rescue stretcher 100 to ensure that the driver is being pulled rearwardly along with the rescue stretcher 100. As the rescue stretcher 100 is continuously pulled, the driver is dislodged from the driver seat and transported rearwardly away from the driver's cabin through the narrow passageway toward a rear portion of the vehicle. Once the driver has cleared some or all of the narrow passageway, the driver may be unbuckled from the rescue stretcher 100 and repositioned on the base panel 105 for proper securement in a similar method as described previously with reference to FIGS. 2-3. Thereafter, the injured driver may be lifted for air evacuation or otherwise transported as described previously.

Another feature of the rescue stretcher 100 is that it can be quickly reset for subsequent use. With general reference to FIGS. 1-3, the following discussion provides additional details regarding the resetting process. Once the person 50 has been removed from the rescue stretcher 100, the lift slings 350, 355 may be released from the carabiner 410 and pulled back through the openings 405 of the base panel 105. Thereafter, the lift slings 350, 355 may be coiled into a tight package and tied to or otherwise coupled to the webbing of any of the securement straps 315 to retain the lift slings 350, 355 in a convenient deployment position. In other embodiments, the lift slings 350, 355 may instead be coiled and stored in other suitable locations.

Thereafter, the securement straps 315 are straightened out and stretched across the base panel 105. The webbing of the securement straps 315 is pulled through the slits 335, 340 until the buckle parts 320, 325 are adjacent the left and right peripheral edges 130, 135 of the base panel 105. As noted previously, the rescue stretcher 100 may be stored in a rolled-up configuration or may be stored in a flat and folded configuration. To roll the rescue stretcher 100, the rescue stretcher 100 is first laid flat with all straps secured as described previously. Thereafter, the drag handle 185 is initially moved aside and the header end 110 is curled inwardly. To keep the rescue stretcher 100 tightly rolled and small, the rescue personnel may need to apply pressure using one or both knees. The drag handle 185 may be returned and the rescue stretcher 100 is continually rolled all the way to the footer end 115, while ensuring that the foot end straps 400 remain exposed along the left and right peripheral edges 130, 135 and along the footer end 115. Once the rescue stretcher 100 has been entirely rolled, the foot end straps 400 may be fastened to one another to retain the rescue stretcher 100 in a rolled configuration and ready for deployment. With reference to FIGS. 7-8 below, the following provides additional details relating to an example method for folding and storing the rescue stretcher 700.

With reference to FIGS. 7 and 8, the following describes a folding configuration for the rescue stretcher 700. With reference to FIG. 7, the rescue stretcher 700 may include the same or substantially similar features as described previously with reference to the rescue stretcher 100. Accordingly, such features of the rescue stretcher 700 may not be numbered in FIG. 7 and are not further described with reference to the embodiment illustrated in FIG. 7 to avoid repetition and/or obscuring more pertinent aspects of the embodiment. However, it should be understood that the rescue stretcher 700 may nevertheless include all or a subset of the features described with respect to the rescue stretcher 100 of FIG. 1 even though such features are not further described with reference to the rescue stretcher 700. In addition, the rescue stretcher 700 may also be used in place of the rescue stretcher 100 for air evacuation and/or evacuation in narrow passageways as described previously.

As illustrated in FIG. 7, the rescue stretcher 700 includes an elongated base panel 705 formed of a lightweight and flexible material with strength and durability characteristics suitable for supporting the weight of an injured person (not shown) during transport. Base panel 705 includes a header end 710 and a footer end 715 opposite header end 710. Base panel 705 further includes a front surface 720 for receiving the injured person and an opposite rear surface (not shown) that may contact the ground, such as during a dragging extraction, as noted previously with reference to the rescue stretcher 100 of FIG. 1. The base panel 705 further includes opposite left and right peripheral edges 730, 735.

With reference to FIG. 7, the rescue stretcher 700 further includes a first crease 740 and a second crease 745 formed along the base panel 705 for facilitating folding of the rescue stretcher 700. The creases 740, 745 may be formed by any suitable method, such as by subjecting the base panel 705 to heat and pressure to fold a previously flat and uniform the base panel 705 and create the crease at a desired location. In one embodiment, the first crease 740 may extend across the base panel 705 from the left peripheral edge 730 to the right peripheral edge 735, the crease 740 traversing across a vertical central axis A of the base panel 705 which extends from the header end 710 to the footer end 715, where the central axis A divides the panel 705 in two. Similarly, the second crease 745 may extend across the base panel 705 from the left peripheral edge 730 to the right peripheral edge 735, the crease 745 also traversing across the vertical axis A. In this configuration, the creases 740, 745 are offset from one another and parallel to a longitudinal axis B extending from left peripheral edge 730 to the right peripheral edge 735 and crossing vertical axis A.

In some embodiments, the creases 740, 745 may be approximately 1 mm wide with 2 mm of standard, uncompressed base panel material positioned in between to accommodate folding. The creases 740, 745 may be arranged to accommodate folding of the rescue stretcher 700 in any suitable configuration. For example, the creases 740, 745 may be arranged such that the rescue stretcher 700 is essentially divided into a first flap 720A, a middle section 720B, and a second flap 720C, where the flaps 720A, 720C and the middle section 720B are substantially equal in length such that the base panel 705 is essentially divided in thirds. In other embodiments, the creases 740, 745 may be arranged such that the flaps and sections are substantially the same size, but not necessarily equal. For example, in one embodiment, the second flap 720C and middle section 720B may each comprise approximately 35% of the length of the rescue stretcher 700, and the first flap 720A may comprise approximately 30% of the length of the rescue stretcher 700. Other embodiments may use other suitable configurations for the creases 740, 745, and/or may include more or fewer than two creases as desired.

FIG. 8 illustrates the rescue stretcher 700 in a folded configuration. The following provides additional details regarding the folding process for the rescue stretcher 700. With reference to FIGS. 7 and 8, in one embodiment, the second flap 720C may be folded upwardly along the crease 745 and toward the middle section 720B. In embodiments where the second flap 720C and the middle section 720B are substantially equal lengths, the footer end 715 is substantially aligned with the first crease 740 when the second flap 720C is folded onto the middle section 720B.

After the second flap 720C has been folded, the first flap 720A is folded downwardly along the crease 740 and toward the middle section 720B. Once the first flap 720A is completely folded over the crease 740, the first flap 720A rests against the second flap 720C as shown in FIG. 8. Once both flaps 720A, 720C are folded over toward the middle section 720B, the rescue stretcher 700 may be retained in the folded configuration with a retaining strap 750, which extends around the bottom surface of the base panel 705 and buckles over the first flap 720A. In this configuration, the rescue stretcher 700 has an overall square-shaped configuration with the crease lines 740, 745 being positioned at the header and footer ends, respectively, of the folded rescue stretcher 700 as illustrated in FIG. 8.

As described, the folded rescue stretcher 700 illustrated in FIGS. 7 and 8 provides a smaller overall footprint (as compared to the rolled-up configurations described earlier with reference to rescue stretcher 100) and facilitates stacking the rescue stretchers 700 on top of one another for compact storage. In addition, the folded configuration may be easier and faster to package following deployment as compared to the rolled-up configuration. In addition, the folded rescue stretcher 700 may be used for the same evacuation activities as the rolled-up configuration.

It should be understood that many of the components and arrangements described in the embodiments of FIGS. 1-8 are for illustration purposes. Accordingly, one having ordinary skill in the art may rearrange the components of the embodiments described herein without departing from the principles of the disclosure.

In addition, it is intended that subject matter disclosed in portion herein can be combined with the subject matter of one or more of other portions herein as long as such combinations are not mutually exclusive or inoperable. In addition, many variations, enhancements and modifications of the rescue stretcher concepts described herein are possible.

The terms and descriptions used above are set forth by way of illustration only and are not meant as limitations. Those skilled in the art will recognize that many variations can be made to the details of the above-described embodiments without departing from the underlying principles of the invention.

The invention claimed is:

1. A method of using a rescue stretcher to remove an injured person from a confined area, the method comprising:

deploying the rescue stretcher adjacent the injured person in the confined area, the rescue stretcher including an elongate, flexible panel sized to underlay the injured person, the panel including a header end and an opposite footer end, a first side and an opposite second side, and a first securement strap coupled to the flexible panel, the first securement strap including a first segment with a first strap buckle and a second segment with a second strap buckle, wherein the first securement strap extends transversely across the flexible panel from the first side to the second side thereof when the first and second strap buckles mate with one another, the rescue stretcher further including a fastener device coupled thereto;

arranging the header end of the rescue stretcher in the confined area and adjacent the injured person;

securing the fastener device of the rescue stretcher to the injured person;

pulling the rescue stretcher along the footer end of the flexible panel, urging the fastener device to drag the injured person away from the confined area; and securing the injured person to the rescue stretcher once away from the confined area.

2. The method of claim 1, further comprising securing the first securement strap to the injured person prior to the step of pulling the rescue stretcher.

3. The method of claim 2, wherein the step of securing the first securement strap to the injured person further includes securing the first securement strap to a torso or limb of the injured person.

4. The method of claim 1, further comprising positioning the injured person on the flexible panel of the rescue stretcher such that the flexible panel entirely underlays the injured person prior to the step of securing the injured person to the rescue stretcher.

5. The method of claim 4, wherein the step of securing the injured person comprises recoupling the first securement strap after the step of positioning the injured person.

6. The method of claim 1, the rescue stretcher further including one or more loop handles coupled along the footer end of the flexible panel, the method further comprising the step of grasping at least one of the one or more loop handles prior to the step of pulling the rescue stretcher.

7. The method of claim 1, further comprising removing any attached restraint from the injured person prior to the step of pulling the rescue stretcher.

8. The method of claim 1, wherein the rescue stretcher further comprises a second securement strap coupled to the flexible panel, the second securement strap including a first segment with a first strap buckle and a second segment with a second strap buckle, and wherein the step of securing the injured person to the rescue stretcher includes securing the first and second securements straps over the person.

9. The method of claim 1, further comprising lifting the rescue stretcher, via one or more loop handles coupled thereto, and carrying the rescue stretcher away from the confined area.

10. The method of claim 1, the rescue stretcher further comprising a plurality of lift sling straps coupled thereto, the method further comprising:

coupling the fastener device to gather the plurality of the lift sling straps after the step of securing the injured person; and coupling the fastener device to an extraction line for carrying the rescue stretcher and injured person.

11. The method of claim 1, the rescue stretcher further including a first crease formed along the flexible panel, and a second crease formed along the flexible panel, the rescue stretcher being foldable along the first and second creases, wherein the step of deploying the rescue stretcher further includes unfolding the rescue stretcher along the first and second creases.

12. The method of claim 1, wherein the step of securing the fastener device to the injured person further includes securing the fastener device to an article of clothing worn by the injured person.

13. The method of claim 1, further comprising cutting or tearing an article of clothing worn by the injured person to form an opening thereon after the step of deploying the rescue stretcher adjacent the injured person in the confined area, and wherein the step of securing the fastener device of the rescue stretcher further comprises securing the fastener device to the opening on the article of clothing worn by the injured person.

14. The method of claim 1, the rescue stretcher further including one or more loop handles coupled thereto, wherein the fastener device is coupled to one of the one or more loop handles of the rescue stretcher.

* * * * *